US007379687B2

(12) United States Patent
Kawasumi

(10) Patent No.: US 7,379,687 B2
(45) Date of Patent: May 27, 2008

(54) IMAGE FORMING APPARATUS WITH FIRST AND SECOND OPENING AND CLOSING UNITS

(75) Inventor: Ryoichi Kawasumi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 283 days.

(21) Appl. No.: 11/269,746

(22) Filed: Nov. 9, 2005

(65) Prior Publication Data

US 2006/0104662 A1 May 18, 2006

(30) Foreign Application Priority Data

Nov. 12, 2004 (JP) ..... 2004-329643

(51) Int. Cl.
*G03G 15/00* (2006.01)

(52) U.S. Cl. ..... 399/110; 399/124

(58) Field of Classification Search ..... 399/110, 399/124

See application file for complete search history.

(56) References Cited

U.S. PATENT DOCUMENTS 5,119,134 A * 6/1992 Haneda et al. ..... 399/116
5,140,369 A * 8/1992 Haneda et al. ..... 399/112
6,343,198 B1 * 1/2002 Sato ..... 399/121
6,801,742 B1 * 10/2004 Mochimaru et al. ..... 399/124
6,996,354 B2 * 2/2006 Kimura et al. ..... 399/121
2003/0235430 A1 * 12/2003 Koshida ..... 399/124
2004/0101328 A1 * 5/2004 Kimura et al. ..... 399/121
2004/0208670 A1 * 10/2004 Abe ..... 399/110
2006/0002738 A1 * 1/2006 Kurita ..... 399/124
2006/0104661 A1 * 5/2006 Nakanishi ..... 399/110
2006/0104662 A1 5/2006 Kawasumi ..... 399/110

FOREIGN PATENT DOCUMENTS

JP 2001-242680 9/2001
JP 2003-202728 7/2003
JP 2004-85899 3/2004

* cited by examiner

*Primary Examiner*—David M Gray
*Assistant Examiner*—Ryan D. Walsh
(74) *Attorney, Agent, or Firm*—Fitzpatrick, Cella, Harper & Scinto

(57) ABSTRACT

An image forming apparatus of the present invention has a first opening and closing unit that is opened to thereby expose said convey path and a second opening and closing unit that have a recording material stacking section and can open the image forming unit to support intermediate transfer. The second opening and closing unit can be operated be to open or close at the time that the first opening and closing unit is opened.

8 Claims, 5 Drawing Sheets

(a)
PRIOR ART (b)
PRIOR ART

IMAGE FORMING APPARATUS WITH FIRST AND SECOND OPENING AND CLOSING UNITS

BACKGROUND OF THE INVENTION

1. Field of the Invention

The invention relates to an image forming apparatus, such as a full-color copying machine, a printer, etc., which forms an image on a recording material by using an electrophotographic method.

2. Related Background Art

In these days, an electrophotographic multicolor or full-color image forming apparatus includes a so-called in-line type image forming apparatus, which is disclosed in Japanese Patent Application Laid-Open (JP-A) No. 2001-242680, JP-A No. 2003-202728, and JP-A No. 2004-85899. This in-line type image forming apparatus comprises, as shown in FIGS. 5A and 5B, a plurality of photosensitive drums 100 of respective colors arranged in one line. The image forming apparatus forms color toner images on the photosensitive drums 100, respectively, sequentially superposes the respective formed color toner images onto an intermediate transfer belt 101 to thereby form a color image, secondarily transfers the superposed toner images onto a sheet being conveyed, heat-fixes the superposed toner images to the sheet using a fixing unit, and then discharges the sheet to an output tray 102. According to the above construction, since an exposing unit is disposed at the bottom surface side, it is capable of decreasing a distance at which the toner images are transferred from image forming unit to the intermediate transfer belt 101 and a location at which the color image is transferred from the intermediate transfer belt 101 to the recording material, which effectively shortens a copying time of first sheet.

In such an image forming apparatus, each of the image forming unit 100 and the intermediate transfer belt 101 has a life which is shorter than that of the image forming apparatus main body by its nature; therefore, they need replacement in order to complete the life of the main body. Therefore, as disclosed especially in JP-A No. 2004-85899, an upper cover unit 103 having the output tray 102 and the intermediate transfer belt 101 is, as shown in FIG. 5B, swingably adapted to the image forming apparatus main body in order to make the image forming unit 100 and the intermediate transfer belt 101 replaceable. As a result, swinging the upper cover unit 103 toward above the main body (in the direction of an arrow C in FIG. 5B) enables a user to freely access to both the image forming unit 100 and the intermediate transfer belt 101, which improves the maintainability.

On the contrary, in the above constructed image forming apparatus, in order to easily remove a jammed sheet (clogging sheet) from a sheet convey path, it is considered to rotatably construct a front cover unit 104 as a unit containing the sheet convey path, thereby causing the sheet convey path to be constructed openably.

In this construction mentioned above, because the upper cover unit supports intermediate transfer belt, an opening space formed by the movement of the upper cover unit is necessary to be large. If recording material is stacked on the upper cover unit after fixing process, a distance between the fixing and discharging portion and the upper cover unit is small and they interferes each other when the upper cover unit is opened. On the other hand, if the distance between fixing and discharging portion and the upper cover unit is set large for the upper cover unit can be opened easily, the width of the image forming apparatus becomes large. So it is necessary to reduce the interferance between the upper cover unit at an opening position and the fixing and discharging portion without making the width of the image forming apparatus large.

SUMMARY OF THE INVENTION

The purpose of the present invention is to reduce the interferance between the upper cover unit at an opening position and the fixing and discharging portion without enlarging the width of the image forming apparatus.

It is another object of the invention is to provide an image forming apparatus comprising an image formation unit that forms a toner image; an intermediate transfer member that bears the toner image transferred from the image formation unit; a convey path that conveys a recording material on which an image is formed due to the toner image born on the intermediate transfer member; a first opening and closing unit that is opened to thereby expose the convey path; a second opening and closing unit that have a recording material stacking section and can open the image forming unit to support intermediate transfer; the second opening and closing unit can be operated be to open or close at the time that the first opening and closing unit is opened.

A further object of the invention will be clarified in the descriptions below.

DETAILED DESCRIPTION OF THE EMBODIMENTS

Then, the invention will be described in detail with reference to the drawings showing an embodiment of the invention.

[Whole Arrangement of Image Forming Apparatus]

Figure 1:
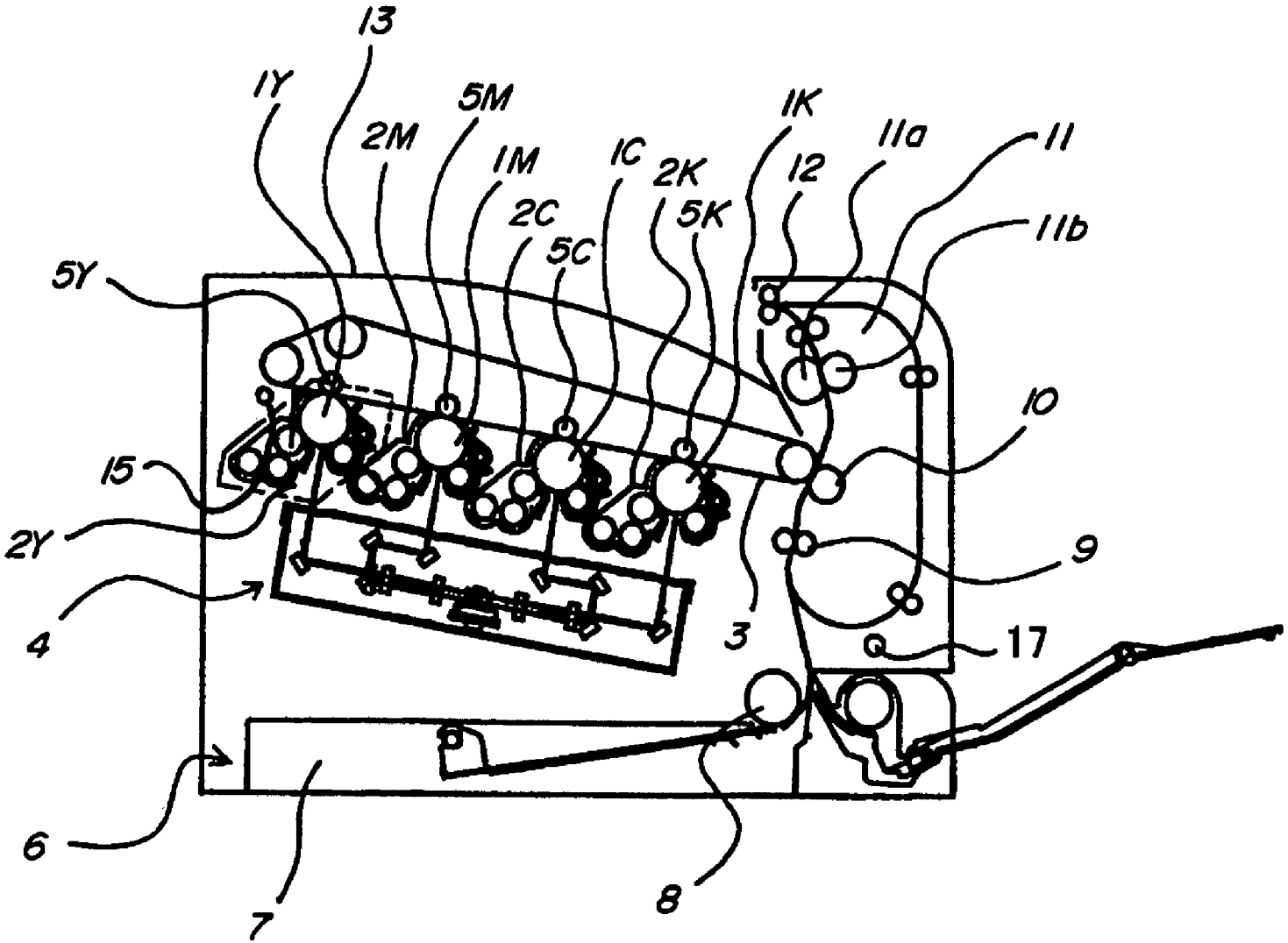
FIG. 1 is a sectional explanatory view of an image forming apparatus of the invention.

Referring first to FIG. 1, there is illustrated a whole construction of an image forming apparatus. FIG. 1 is a sectional diagrammatical explanatory view of the image forming apparatus.

An image forming apparatus shown in FIG. 1 has photosensitive drums 1 (1Y, 1M, 1C, 1K), as image bearing members, for bearing toner images formed thereon of yellow, magenta, cyan, and black colors. Around each of the photosensitive drums 1 are deposed of a charger for charging the respective photosensitive drums 1, a development unit for developing an electrostatic latent image formed on the photosensitive drum 1 due to exposure, and a cleaner for cleaning the toner on the photosensitive drum 1 after the transfer, all of which are unitized into a process cartridge 2 (2Y, 2M, 2C, 2K), as an image formation unit. An intermediate transfer belt 3, as an example of a belt member, which is an intermediate transfer member, is disposed above the process cartridges 2 so as to contact the respective photosensitive drums 1.

Further, disposed below the process cartridges 2 is an exposing unit 4 for irradiating laser lights to the photosensitive drums 1 selectively to thereby carry out exposure according to an image signal.

The chargers charge the photosensitive drums 1, respectively. The exposing unit 4 exposes optical images of yellow, magenta, cyan, and black colors to the photosensitive drums 1 to form latent images of yellow, magenta, cyan, and black latent thereon. The development units develop the respective latent images to thereby form images of yellow, magenta, cyan, and black toner on the photosensitive drums 1.

Rotation of the photosensitive drums 1 causes the toner images to reach primary transfer sections at which the photosensitive drums 1 abut to the intermediate transfer belt 3. These toner images are sequentially transferred to the intermediate transfer belt 3 by the primary transfer rollers 5 (5Y, 5M, 5C, 5K) which are disposed so as to be opposed to the respective photosensitive drums 1. To the primary transfer rollers 5 are applied primary transfer biases from an electrical equipment board described later.

Sheets (recording materials) contained in a sheet cassette 7 loaded into a lower portion of the apparatus main body 6 are fed one by one in synchronization with the above-mentioned image forming by a feeding roller 8, and then timed by registration rollers 9. Thereafter, the sheet is conveyed up to a secondary transfer section. This secondary transfer section has a secondary transfer roller 10, as a secondary transfer unit, abutting to the intermediate transfer belt 3 and hence being rotatively driven. The sheet is conveyed to the secondary transfer section, applying the bias to the secondary transfer roller 10 causes the toner image on the intermediate transfer belt 3 to be secondarily transferred in block to the sheet.

Then, the sheet having the toner image transferred thereon is conveyed to a fixing unit 11 comprising a heating roller 11*a* as an image heating member and a pressure roller 11*b* as a pressure member, and hence subjected to heat and pressure by the fixing unit 11, thereby causing the not-yet-toner image to be fixed to the sheet, which causes the respective color toners to be molten and mixed in color to provide a full color print image fixed to the sheet P. Thereafter, the sheet is discharged to an output tray 13, as a recording material stacking section, by a pair of discharge rollers 12 disposed at a location downstream of the fixing unit 11.

Thus constructed image forming apparatus according to this embodiment has the sheet cassette 7, the exposing unit 4, the process cartridges 2, the intermediate transfer belt 3, and the output tray 13, in the order named from the lower portion of the apparatus main body to the upper portion. Therefore, the sheet convey path, as a convey path, is formed so as to convey the sheet from bottom to top.

Further, in the apparatus main body 6 is disposed a fixed power supply, and a main electric equipment board for controlling the whole image forming apparatus. The main electric equipment board is disposed in a space between the exposing unit 4 and the sheet cassette 7.

A plane including primary transfer sections at which the four photosensitive drums 1 abut to the intermediate transfer belt 3 is declined on a side of the secondary transfer section. In this embodiment, this declination is angled at about 15°; accordingly, the respective process cartridges 2 and the exposing unit 4 also are declined at the same angle.

Moreover, in FIG. 1 showing the image forming apparatus according to the embodiment, a front side of the apparatus is directed to the right-hand side, and then a user carries out various kinds of the operations from the front side.

[Opening and Closing Section]

Next, there will be described an opening and closing section which is capable of opening and closing with respect to the apparatus main body 6.

Figure 2:
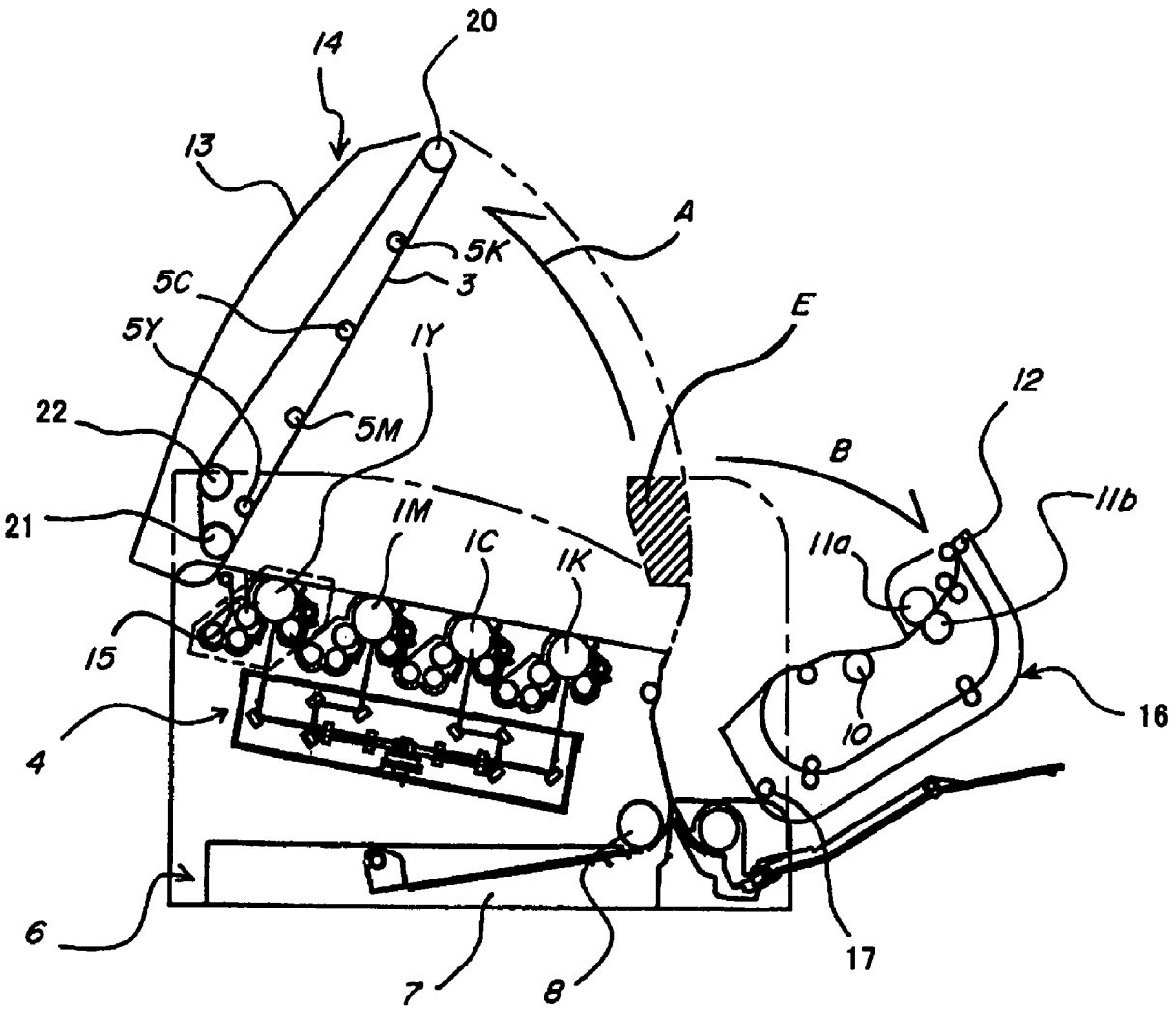
FIG. 2 is a sectional explanatory view of the image forming apparatus, which shows a state in which an upper cover unit and a front cover unit are opened, respectively.

As shown in FIG. 2, the image forming apparatus according to the embodiment has a front cover unit 16, as a first opening and closing unit, arranged on a front side of the apparatus main body 6. This front cover unit 16 is rotatable around a pivot shaft 17 with respect to the apparatus main body 6; therefore, rotating the front cover unit 16 enables the front side of the apparatus main body 6 to be opened and closed.

The front cover unit 16 has the second transfer roller 10 and the fixing unit 11 disposed therein. As shown in FIG. 2, opening the front cover unit 16 causes the sheet convey path to be exposed, thereby enabling the jammed sheet to be removed easily. Also, the pivot shaft 17 is disposed in a lower portion of the apparatus main body 6, and hence rotatably opening an upper part of the front cover unit 16 causes the sheet convey path to be opened wide.

Further, disposed in the upper portion of the apparatus main body 6 is an upper cover unit 14 as a second opening and closing unit. The upper cover unit 14 is rotatable around a pivot shaft 15 with respect to the apparatus main body 6; therefore, rotating the upper cover unit 14 enables the upper portion of the apparatus main body 6 to be opened or closed.

To the upper cover unit 14 is attached an intermediate transfer unit having the intermediate transfer belt 3 unitized therein. Therefore, as shown in FIG. 2, opening the upper cover unit 14 causes the process cartridges 2 including the photosensitive drums 1, to be exposed, with easy replacement (loading/unloading) of the cartridges 2. Further, since the intermediate transfer belt 3 disposed in the upper cover unit 14 also is exposed, its replacement is carried out easily.

On this occasion, in the image forming apparatus according to this embodiment, the upper cover unit 14 is adapted to be able to be opened only during the interval when the front cover unit 16 opens.

That is, as shown in FIG. 2, the upper cover unit 14 is opened rotatably toward above the apparatus main body 6 around a pivot shaft 15 (in the direction of an arrow A). On this occasion, the upper part of the front cover unit 16 protrudes on a side of the upper cover unit 14. In this embodiment, the fixing unit 11 is disposed in the upper part of the front cover unit 16 so as to be positioned above the secondary transfer section, and further a part of the fixing unit 11 protrudes toward the upper cover unit 14.

Therefore, when the upper cover unit 14 is opened with the front cover unit 16 closed, the swing excursion of the upper cover unit 14 interferes with the front cover unit 16 at a hatching range E in FIG. 2. On the contrary, during the interval when the front cover unit 16 opens in the direction of an arrow B in FIG. 2, it is capable of preventing the interference, thereby enabling the upper cover unit 14 to be opened in the direction of the arrow A.

Moreover, when the front cover unit 16 is closed, the upper cover unit 14 is closed before the front cover unit 16 is closed, contrary to a case in which the front cover unit 16 is opened.

That is, in the image forming apparatus according to the embodiment, the upper cover unit 14 can be opened or closed only during the interval when the front cover unit 16 opens.

As described above, since the fixing unit 11 is not disposed in the upper cover unit 14, but disposed in the front cover unit 16, it is capable of easily opening and closing the upper cover unit 14 without sacrificing the maintainability.

Further, since the primary transfer plane is declined as described above, a surplus space is formed below the exposing unit 4, in which is contained various kinds of electrical equipment boards which should be originally placed in the depth direction or in the width direction of the image forming apparatus. This decreases a volume of the whole image forming apparatus.

[Drive Transmission Construction]

Next, there will be described a drive transmission construction to the intermediate transfer belt 3.

Figure 3:
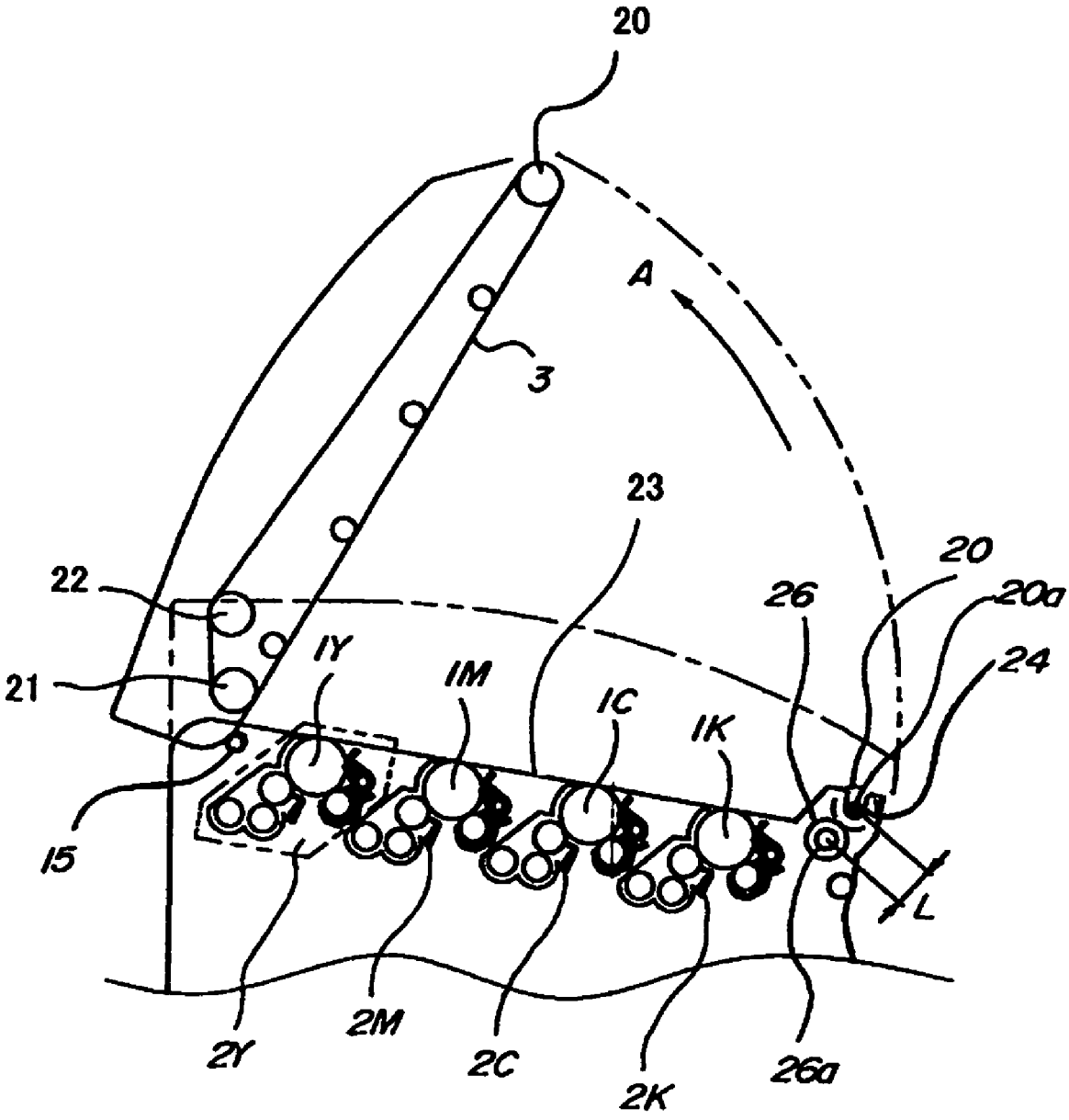
FIG. 3 is an enlarged detail view of a part of an image forming apparatus main body receiving the upper cover unit.

As shown in FIG. 3, the intermediate transfer belt 3 is supported by a driving roller 20, a driven roller 21, and a tension roller 22, all of which are disposed in the upper cover unit 14. The driving roller 20 is adapted to rotate due to a driving force transmitted from the apparatus main body 6.

Then, the apparatus main body 6 has side plates made of sheet metal which support the pivot shaft 15 of the upper cover unit 14 and has U-like grooves 24 to which a rotary shaft 20*a* of the driving roller 20. That is, when the upper cover unit 14 is closed, the rotary shaft 20*a* of the driving roller 20 is guided along the U-like groove 24, and finally strikes its bottom, which enables the driving roller 20 to be positioned with certainty and with high accuracy.

Figure 4:
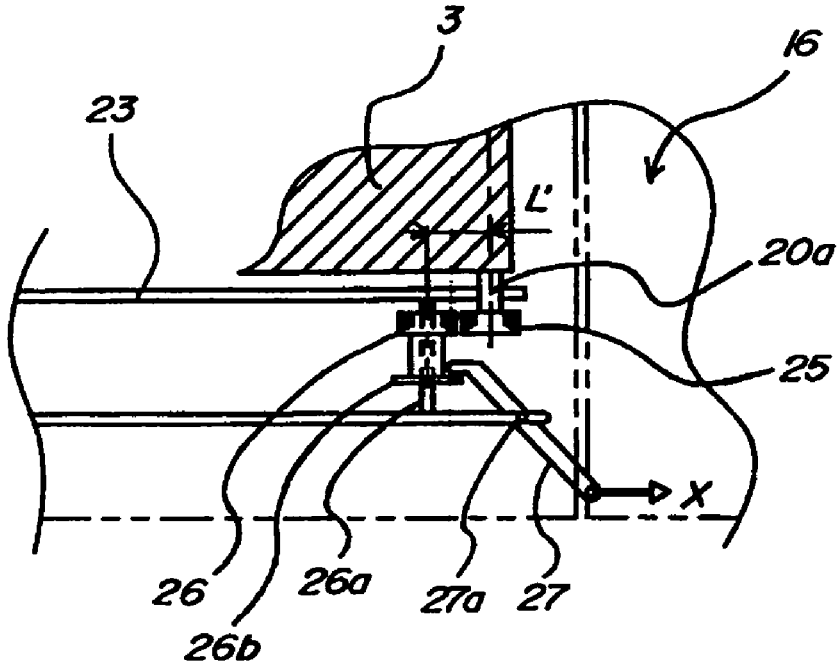
FIGS. 4A and 4B are an explanatory view of a construction of carrying out the drive transmission to an intermediate transfer belt.
Figure 4:
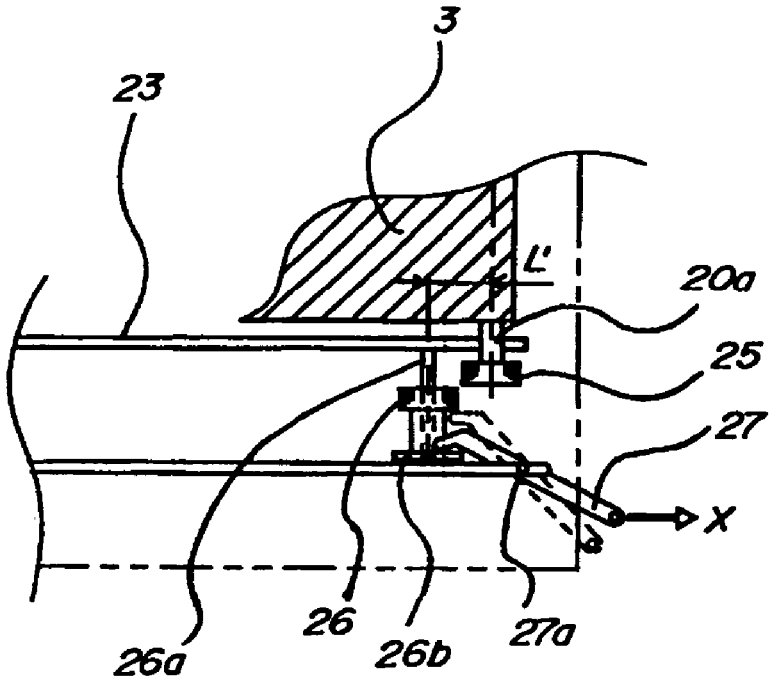
Figure 5:
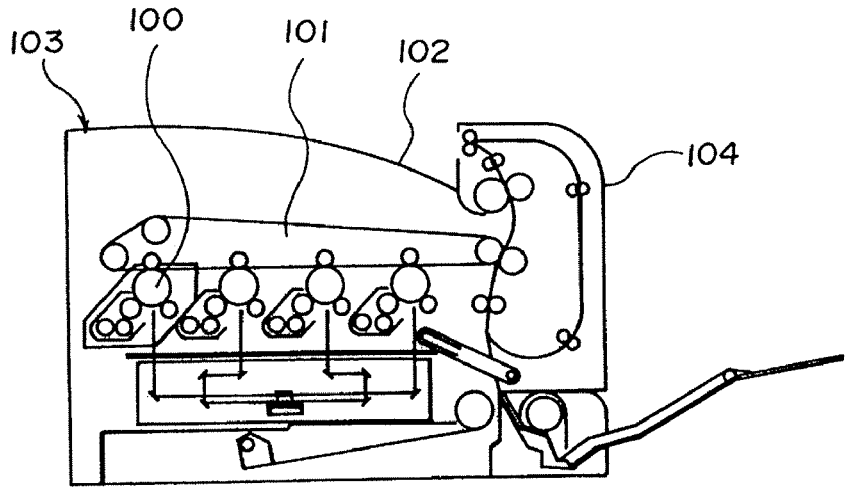
FIGS. 5A and 5B are a sectional side view of a conventional image forming apparatus.
Figure 5:
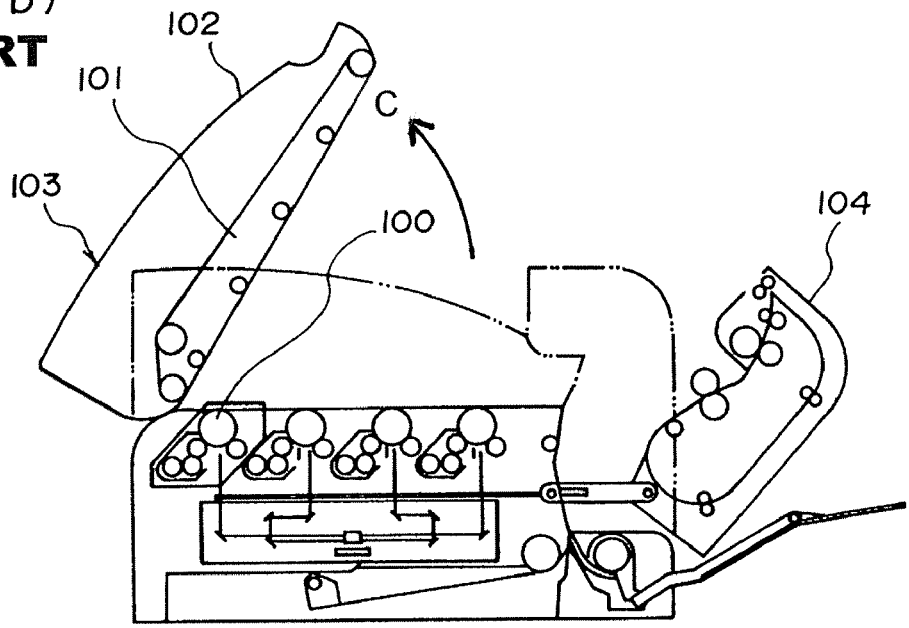

FIG. 4 is an explanatory view, which is useful in explaining a drive transmission construction to the intermediate transfer belt 3. As shown in FIGS. 4A and 4B are, the driving roller 20 of the intermediate transfer belt 3 has a driven gear 25 as a driven transmission member at the end portion.

Besides, the apparatus main body 6 has a driving gear 26, as a first driving transmission member, which is rotatably driven due to a driving force transmitted from a driving source such as a motor. A drive transmission construction from the drive source to the driving gear 26 may comprise a construction of transmitting a driving force from a rotary shaft of the motor to the driving gear 26 directly, or otherwise through another gear. This driving gear 26 is positioned in the apparatus main body 6 by positioning the driving shaft 26*a* with a high degree of accuracy. Then, the driving gear 26 is permanently urged by a compression spring (not shown) toward the side plate 23 (upward in FIGS. 4A and 4B are).

On this occasion, the U-like groove for positioning the driving roller 20 and the driving shaft 26*a* for positioning the driving gear 26 are ensured to be spaced apart by a center distance L (Refer to FIG. 3) with a high degree of accuracy on the same side plates 23. FIGS. 4A and 4B are represents a projective distance L' obtained when the distance L is projected on the top view.

Also, as shown in FIGS. 4A and 4B are, there is disposed a retracting lever 27 rotatably around a rotary shaft 27*a*. This retracting lever 27 is connected with the front cover unit 16 through links (not shown), and hence is positioned at a location shown in FIG. 4A when the front cover unit 16 is closed with respect to the apparatus main body 6, or otherwise positioned at a location shown in FIG. 4B when the front cover unit 16 is opened with respect to the apparatus main body 6.

When the front cover unit 16 is opened, the retracting lever 27 is pulled at its one end through the links (not shown) in the direction of an arrow X in FIGS. 4A and 4B are, thereby causing a leading end of the retracting lever 27 on the other end side with respect to the rotary shaft 27*a* to press a flange 26*b* disposed on an end of the driving gear 26 against the spring (not shown). This causes the driving gear 26 to be slidably retracted in its axial direction up to a location where the driving gear 26 and the driven gear 25 are disengaged with each other, which results in cutting off the drive transmission to the intermediate transfer belt 3.

Adversely, when the front door unit 16 is closed, the retracting lever 27 returns to a location shown in FIG. 4A, thereby causing the driving gear 26 to be pressed toward the side plate 23 due to the spring (not shown) to be slid up to a location at which the driving gear 6 meshes with the driven gear 25. This realizes the drive transmission to the intermediate transfer belt 3 without meshing the both the gears 25, 26 with each other.

That is, the driving gear 26 on a side of the apparatus main body and the driven gear 25 on a side of the intermediate transfer unit are engaged or disengaged with each other according to the opening and closing operation of the front cover unit 16. This ensures the center distance with certainty without tip tooth bearing irrespective of opening or closing operation of the upper cover unit 14.

As described above, according to the image forming apparatus of this embodiment, it is capable of realize a drive transmission through a unit divided portion with a high degree of accuracy without sacrificing the maintainability of the intermediate transfer belt 3 and the process cartridges 2 as consumable parts, and the jammed sheet-removing property.

Moreover, this embodiment is described supposed that in FIG. 1 showing the image forming apparatus according to the embodiment, the front side of the apparatus is directed to the right-hand side; however, the front side of the apparatus may be directed to either side.

Further, in this embodiment, the declination angle of the intermediate transfer unit is set to 15°; however, it is not restricted to this angle, any other declination angle may be selected as occasion demands according to the height of the fixing unit 11, the size of the exposing unit 4, etc. Furthermore, the intermediate transfer unit may be arranged substantially horizontally, without being declined.

In this embodiment also, the upper cover unit 14 and the front cover unit 16 each are rotatable as the opening and closing operation; or otherwise may be sidable as the opening and closing operation with respect to the apparatus main body 6.

In this embodiment, the fixing unit 11 is fitted to the front cover unit 16 integrally, thereby increasing the total weight of the front cover unit 16, which causes a problem of making it difficult to open or close the front cover unit 16. Therefore, even when the upper cover 14 and the front upper cover 16 are opened, respectively, the fixing unit may be constructed so as to be left in the image forming apparatus main body.

According to the above-mentioned construction, it is possible to reduce the interferance between the upper cover unit at an opening position and the fixing and discharging portion without enlarging the width of the image forming apparatus.

The embodiment of the invention is described above in detail; however, the invention may not be restricted to the embodiment, and hence can be variously modified as long as deviated from the gist of the invention.

CROSS-REFERENCE TO RELATED APPLICATION

This application claims the benefit of priority from the prior Japanese Patent Application No. 2004-329643 filed on Nov. 12, 2004 the entire contents of which are incorporated by reference herein.

What is claimed is:

1. An image forming apparatus comprising:

an image formation unit that forms a toner image and which is detachably attached to an image forming apparatus main body;

an intermediate transfer member that bears said toner image transferred from said image formation unit;

recording material conveying means for conveying a recording material along a convey path;

a first opening and closing unit that is capable of being opened to thereby expose said convey path;

a second opening and closing unit, disposed at the image forming apparatus main body, that supports said intermediate transfer member and is capable of being opened simultaneously with opening of said first opening and closing unit a first drive transmission member, disposed in said image forming apparatus main body, for transmitting a driving force from a motor; and a second drive transmission member, disposed in said second opening and closing unit, for transmitting a driving force from said first drive transmission member to said intermediate transfer member by engaging with said first drive transmission member, wherein said first drive transmission member and said second drive transmission member are disengaged in conjunction with the opening operation of said first opening and closing unit.

2. An image forming apparatus as claimed in claim 1, wherein said first drive transmission member is retracted from a location at which said first drive transmission member meshes with said second drive transmission member according to the opening operation of said first opening and closing unit.

3. An image forming apparatus as claimed in claim 1, wherein the first drive transmission member meshing with said second drive transmission member is slid in the direction of a rotary axis of said first drive transmission member in conjunction with said opening and closing operation of the first opening and closing unit.

4. An image forming apparatus as claimed in claim 1, wherein said first opening and closing unit is disposed on a side portion of said image forming apparatus main body, and is capable of opening away from said image forming apparatus main body.

5. An image forming apparatus as claimed in claim 1, wherein said second opening and closing unit is disposed on an upper portion of said image forming apparatus main body, and is capable of opening away from an upper portion of said image forming apparatus main body.

6. An image forming apparatus as claimed in claim 1, further comprising a fixing unit that fixes said image formed on said recording material, and said fixing unit is disposed in said first opening and closing unit.

7. An image forming apparatus as claimed in claim 1, wherein said image forming unit is detachably attachable through an opening portion which is formed when said second opening and closing unit is opened.

8. An image forming apparatus as claimed in claim 1, comprising a plurality of image forming units.

* * * * *

UNITED STATES PATENT AND TRADEMARK OFFICE

CERTIFICATE OF CORRECTION

PATENT NO. : 7,379,687 B2
APPLICATION NO. : 11/269746
DATED : May 27, 2008
INVENTOR(S) : Kawasumi It is certified that error appears in the above-identified patent and that said Letters Patent is hereby corrected as shown below:

ON THE TITLE PAGE:
At Item (57), Abstract, Line 4, “have” should read --has--.
At Item (57), Abstract, Line 6, “be” (second occurrence) should be deleted.

COLUMN 1:
Line 64, “interferes” should read --interfere--.
Line 67, “can” should read --to--.

COLUMN 2:
Line 21, “have” should read --has--.
Line 60, “deposed of” should read --disposed--.

COLUMN 3:
Line 49, “Thus” should read --This--.

COLUMN 5:
Line 19, “to” should read --of--.
Line 34, “to” should read --of--.
Line 35, “and 4B are,” should read --and 4B,--.
Line 50, “and 4B are).” should read --and 4B).--.
Line 55, “are represents” should read --represent--.
Line 59, “and 4B are,” should read --and 4B,--.

UNITED STATES PATENT AND TRADEMARK OFFICE

CERTIFICATE OF CORRECTION

PATENT NO. : 7,379,687 B2
APPLICATION NO. : 11/269746
DATED : May 27, 2008
INVENTOR(S) : Kawasumi It is certified that error appears in the above-identified patent and that said Letters Patent is hereby corrected as shown below:

COLUMN 6:
Line 3, “and 4B are,” should read --and 4B,--.
Line 28, “capable of” should read --possible to--.
Line 34, “supposed” should read --supposing--.
Line 48, “sidable” should read --slidable--.

Signed and Sealed this

Third Day of February, 2009

JOHN DOLL
*Acting Director of the United States Patent and Trademark Office*